US005503275A

United States Patent [19]

Fesquet

[11] Patent Number: 5,503,275

[45] Date of Patent: Apr. 2, 1996

[54] CRATES WITH STACKING AND NESTING METHODS

[76] Inventor: Jacques Fesquet, 12380 Saint Sernin sur Rance, France

[21] Appl. No.: 235,554

[22] Filed: Apr. 29, 1994

Related U.S. Application Data

[62] Division of Ser. No. 90,662, Jul. 13, 1993, abandoned.

[30] Foreign Application Priority Data

Jul. 17, 1992 [FR] France ..... 92 09006
Nov. 27, 1992 [FR] France ..... 92 14587

[51] Int. Cl.[6] ..... B65D 85/62

[52] U.S. Cl. ..... 206/505; 206/509; 206/512

[58] Field of Search ..... 206/509, 512, 206/505

[56] References Cited

U.S. PATENT DOCUMENTS 3,220,603 11/1965 Bromley .
4,579,489 4/1986 Saranitits .

FOREIGN PATENT DOCUMENTS 880165 3/1980 Belgium .

*Primary Examiner*—Joseph M. Moy
*Attorney, Agent, or Firm*—Paul and Paul

[57] ABSTRACT

The invention relates to packaging crate for transport and storage of light vegetables, having the form of a slightly truncated rectangular parallelipiped open towards the top and including five walls delimiting the five other faces of the paralellipiped, and defining the bottom 1, and the four side 2, 3, 4, 5 walls of the cram, and provided with stacking and nesting means 7*a*, 8*a*, 9*a*, 10*a*.

According to the present invention this packaging crate is made of the association of a rigid framework delimited by two lower 1*a* and upper 6*a* peripheral belts, joined by four angled spacer columns 7, 8, 9, 10 to filling pannels formed with spaced slats in a latticework structure with lower rigidity than the elements which constitute the aforementionel frame.

9 Claims, 6 Drawing Sheets

CRATES WITH STACKING AND NESTING METHODS

This is a divisional of copending application(s) Ser. No. 08/090,662 filed on Jul. 13, 1993, now abandoned.

The present invention relates to transportation of merchandise and in particular involves crates for transport and storage of fruits and vegetables.

In general, transport of shipping crates conveyed from the shipping place to the receiving place regardless of their Geographic locations, does not present a problem insofar as the volumes of said crates are filled with fruits or vegetables.

However, transporting the crates back from the originating point to the shipping point poses several problems when said crates are empty. Since the volume of an empty crate is the same as that of a filled crate, the cost of transporting said empty crates back from the originating point to the shipping point is often higher than the initial transport. In effect, therefore, since the expense of transport by road, rail, or water (most frequently used for shipping of agricultural products) is an inherent function of the load volume, transport of said crates has, therefore, little influence on the actual transport cost price whether the crates are empty or full.

Thus, to reduce the transport cost of returning empty crates, it has been proposed to provide these same crates with means of stacking and nesting such that the volume occupied by the nested empty crates, one inside the other, is substantially smaller than the volume of full crates placed one on top of another.

There are two known methods of stacking and nesting:

In the first case, they are composed of projections and cavities provided in the opposite side walls of said crates so as to permit stacking of the crates in an identical position, and their nesting in a position shifted according to a 180° angle so that projections engage into cavities, and vice versa:

In the second case, the means for stacking and nesting consist of two pivoting flaps on the side edges of the aforementioned crate so as to permit the flaps to fold, either inwards parallel to the crate bottom to permit stacking, or outwards to permit nesting of a crate.

A number of improvements, intended to establish correct equilibrium between the rigidity required for stacking full crates with a low cost price, have been implemented to this type of crate manufactured according to known techniques of thermo-plastic injection. In addition, the shape of the crates at the stacking and nesting level (projections, cavities, flaps), has been evaluated in order to improve the ability to stack empty crates, one inside the other.

In accordance with the same objectives, the applicant has developed a packing crate specially designed for the transport and storage of light vegetables. These vegetables are cumbersome, with a low cost price, and are cheap, which have a major effect on their transport and storage costs which must be reduced. Therefore, the applicant has conducted research which has led to the development of a crate whose required rigidity features have been studied with respect to conditioning of light products and which the capacity of nesting must be as large as possible with respect to the crate height in order to facilitate their return in quantity. For this purpose, the crate according to this invention for transport and storage, such as that having a rectangular parallelipiped-shape, with slightly truncated sections, open at the top, comprising 5 walls delimiting the 5 other faces of the parallelipiped and defining at the bottom and the 4 side and longitudinal walls is remarkable in that it is constituted by association of a rigid frame delimited by two lower and upper peripheral belts, connected by 4 angled spacer columns, to filling walls made up of slats of a latticework construction type, with lower rigidity than those of said frame elements.

Thus, the rigid frame of the crate according to the present invention has the function of ensuring non-deformation of the container whereas the filling sides only serve to hold the contents. The distinction between these two functions (retention and resistance to deformation) permits varying the quantities of materials used, especially for the filling sides. In addition, considering that the side wall thickness limits the nesting height, thinner walls increase considerably their packing capacity.

To increase the crate resistance to deformation, the upper peripheral belt shall have the shape of a rib overlapping the 4 angled columns and protruding over the same. Preferably, the spaced slats of said filling walls are arranged vertically so as not to interfere with handling for nesting and separation.

In other respects, the required truncated shape of the crates leaves a gap between the crates juxtaposed at the level of their lower parts which results in play between them when they are subjected to vibrations, mainly during their transport in large quantity. Consequently, this play encourages overlap of the rims of the upper peripheral belts of said crates, an overlap which destabilizes the entire stack, possibly leading to its collapse at the risk of the contents.

To eliminate the risk of overlap, the applicant has also proposed to equip his crate with a wedge fixture made from a flat projection which, attached to the outer side wall of the rim of the upper peripheral belt, extends parallel to the bottom of the crate and at a level slightly lower to that of the farthest end of said rim in such a manner as to permit its wedging below the rim of the contiguous crate. In this manner, this projection prevents overlap of the crate rim to which it is attached, on the rim of the contiguous crate. Preferably, it is provided to place the 2 projections only on one longitudinal rim of the upper peripheral belt to avoid longitudinal clearance of the case wedged in this manner. It is important to remember that each pile of crates may be positioned between 4 other piles of crates, each crate will be at least maintained by another wedged crate, by virtue of its projection. The two projections will be carefully positioned asymmetrically with respect to the center of said longitudinal rim so as to avoid any facing position when two longitudinal contiguous rims are fitted with the wedging according to the present invention.

In the crate of the present invention, according to the first embodiment, the aforementioned means of stacking and nesting permit their stacking in identical positions and their nesting in positions shifted 180°, will be preformed by the 4 angled columns forming braces between the lower and upper peripheral belts. In the crate of the present invention according to the second embodiment, the aforementioned means of stacking and nesting consituted by two flaps hinged on the lateral edges of the crate, the aforementioned columns forming braces will be preformed so as to only permit nesting of one crate inside another.

The abovementioned invention as well as further characteristics and advantages may be best understood by referring to the following description, which sets forth, as examples only, a few embodiments of a crate, taken in connection with the accompanying drawings in which:

FIG. 1 is a perspective view of a crate according to the first embodiment.

FIGS. 1*a* and 1*b* are enlarged perspective views of two details of FIG. 1.

Figure 3A:
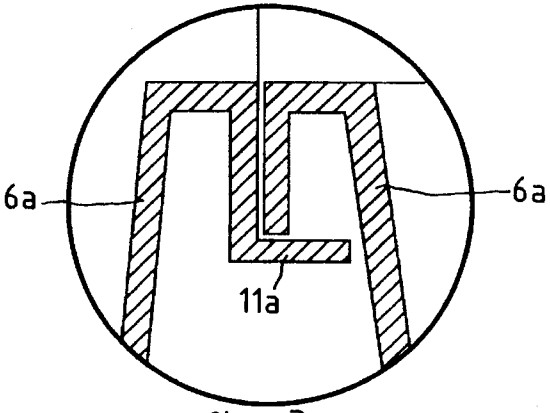
FIG. 3 is a profile view illustrating the juxtaposition of two crates according to the first embodiment.
Figure 3:
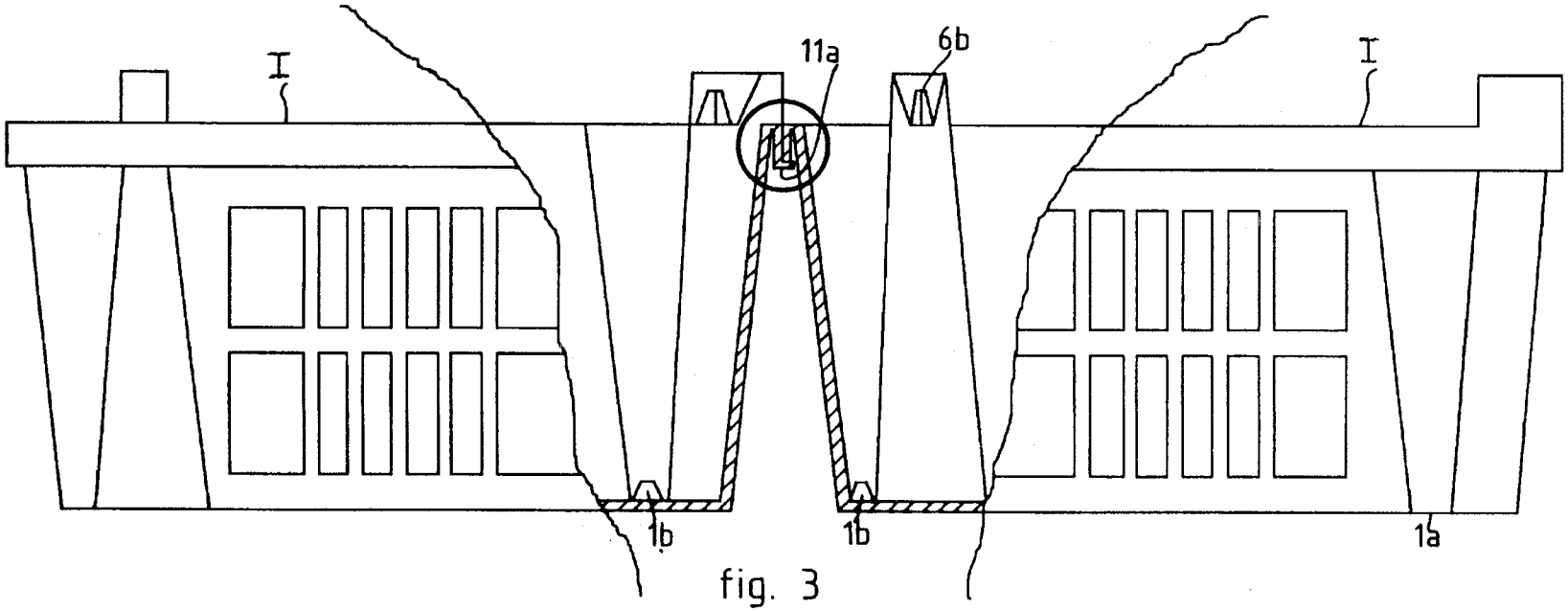

FIG. 3*a* is an enlarged view of FIG. 3.

Figure 4A:
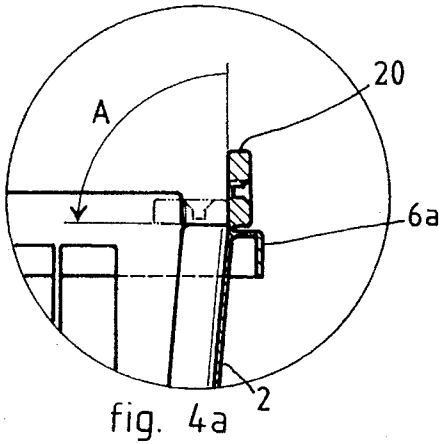
Figure 4B:
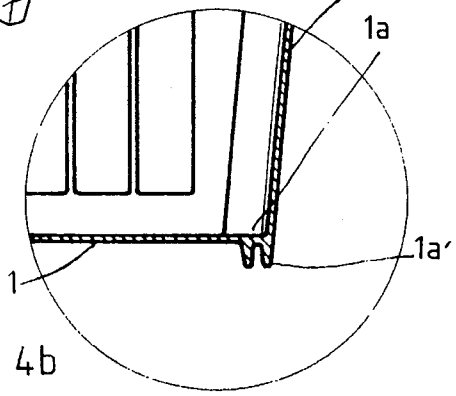
Figure 4:
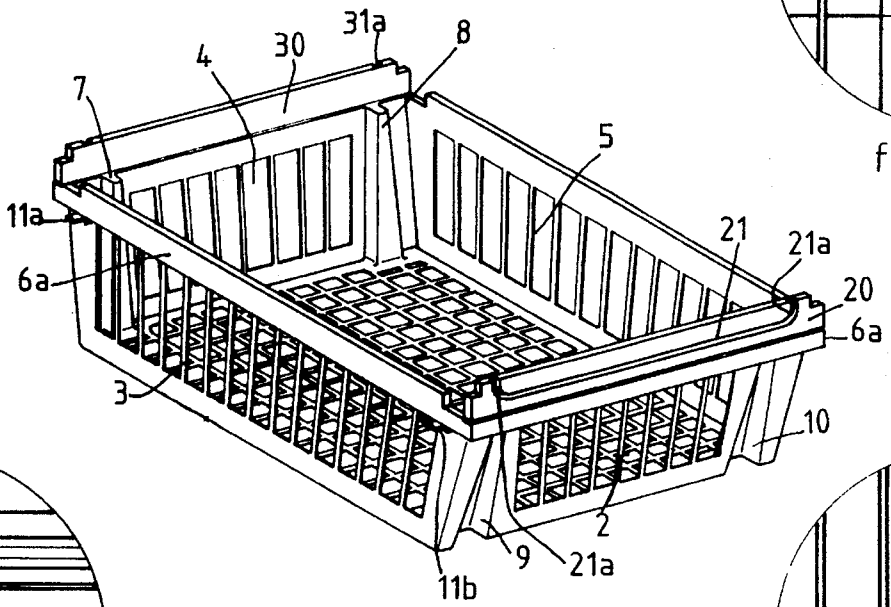

FIG. 4 is a perspective view of a crate according to the second embodiment.

Figure 2:
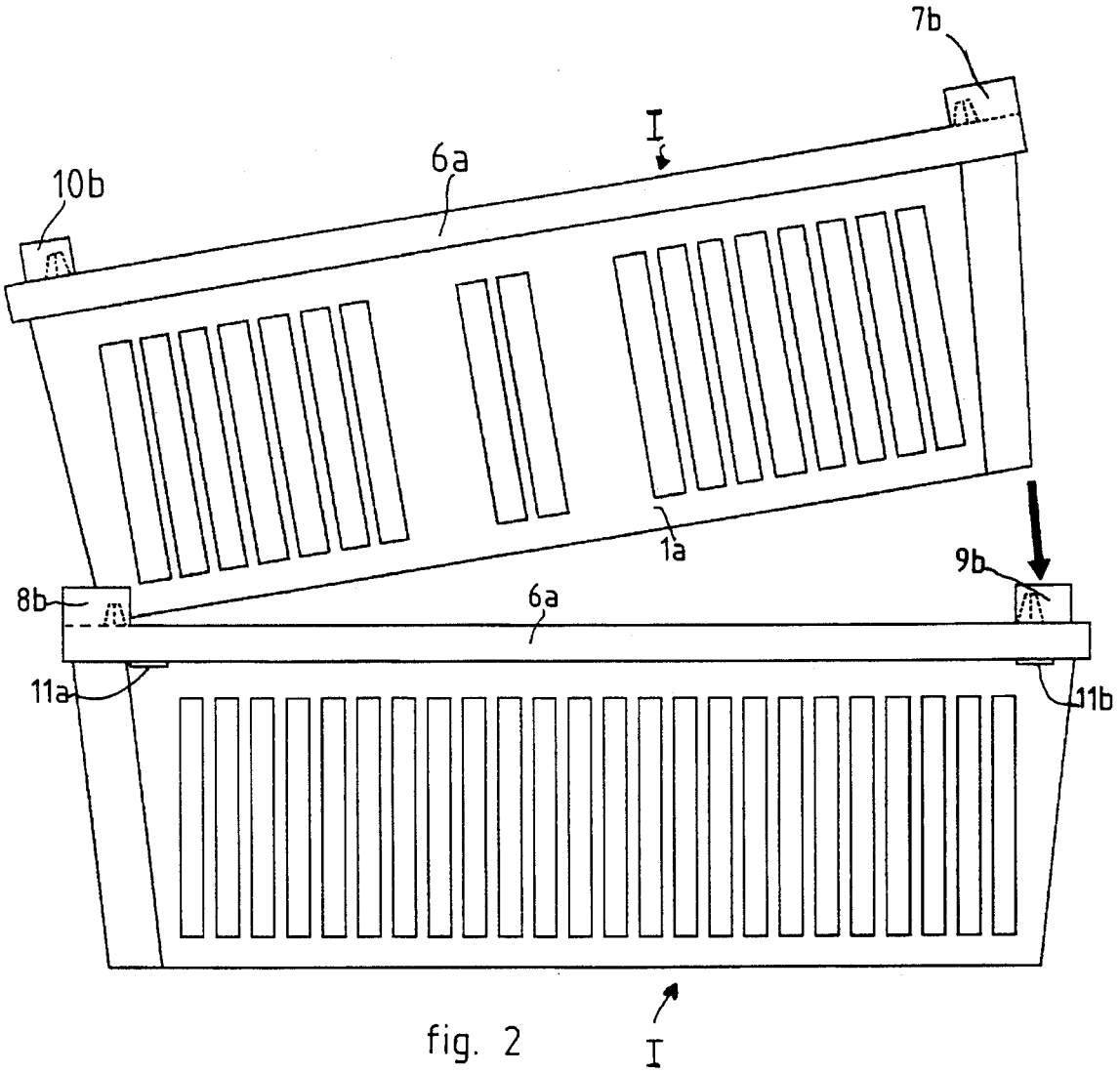
FIG. 2 is a side view illustrating the stacking of two crates according to the first embodiment.
Figure 4C:
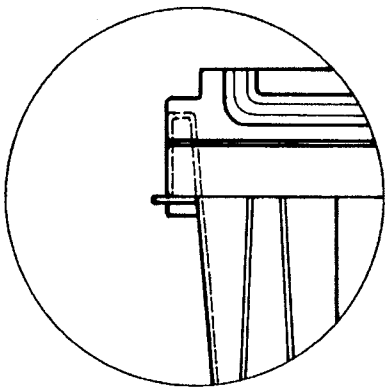

FIGS. 4*a*, 4*b*, and 4*c* are enlarged views of three details of the drawing of FIG. 2.

Figure 5:
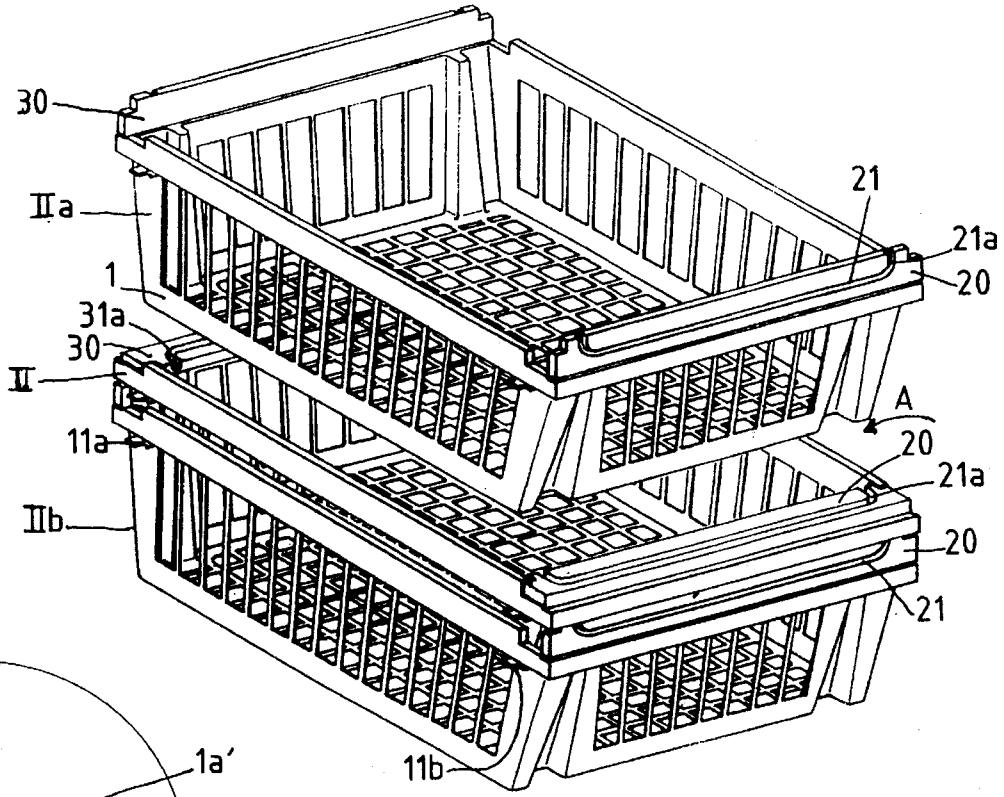

FIG. 5 is a perspective view showing three crates according to the second embodiment, in stacked and nested positions.

Figure 5A:
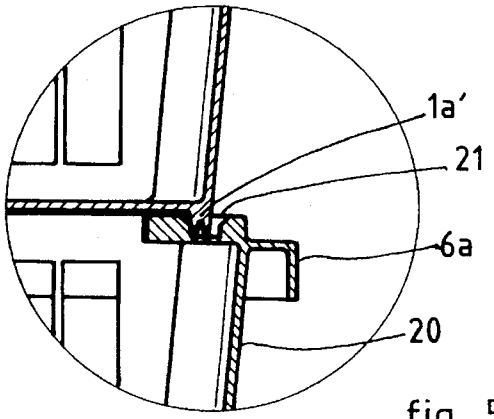

FIG. 5*a* is an enlarged view of a detail of FIG. 5.

Figure 6:
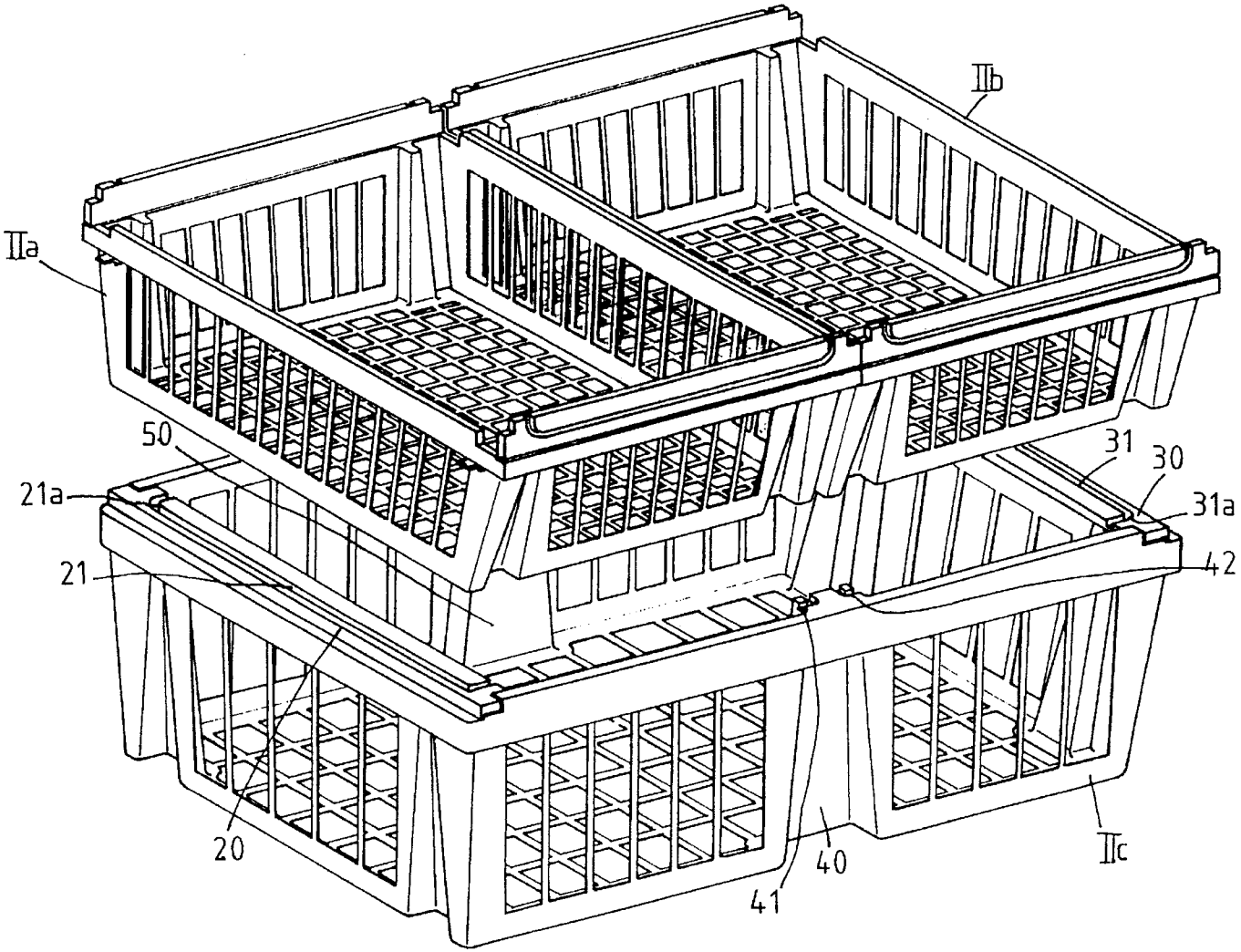

FIG. 6 is a perspective view illustrating the stacking of two small crates on one large crate of the second embodiment.

Figure 1:
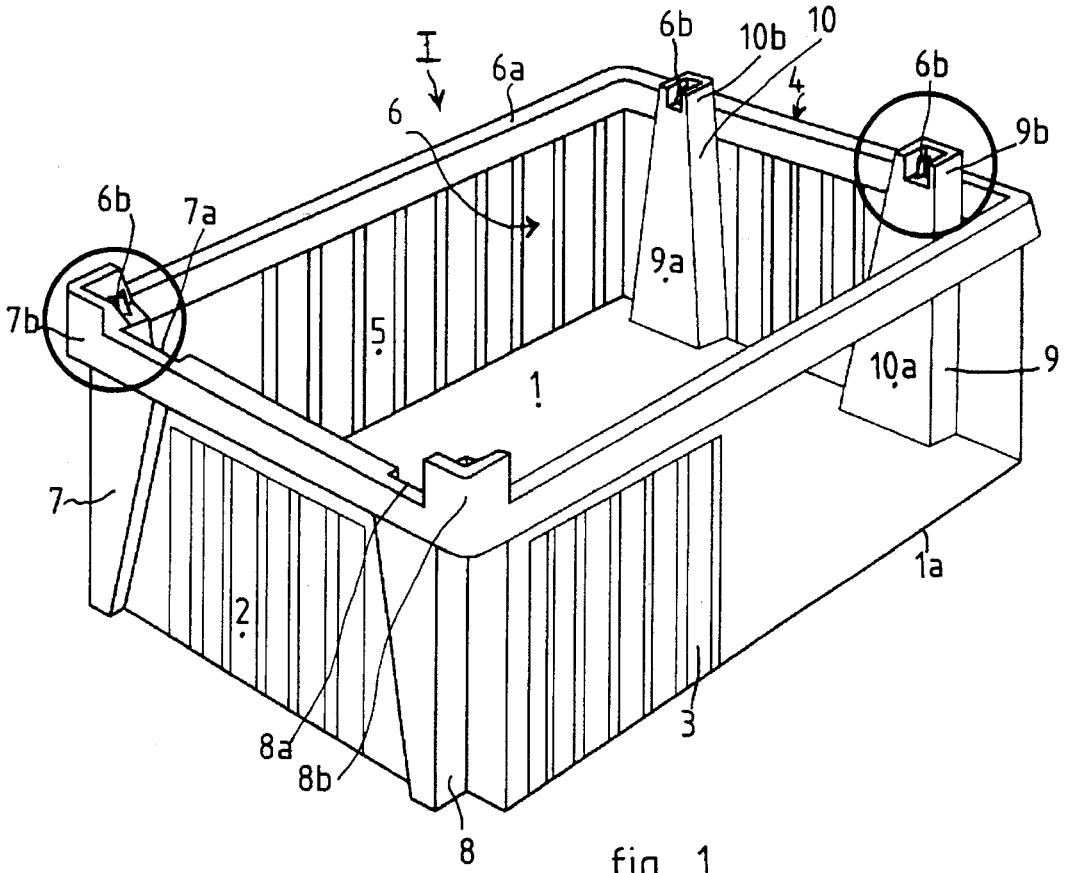

As shown in FIG. 1 and FIG. 6, the crates referenced I and II in their entirety, are designed for transport and storage of light vegetables. Each of these crates has the shape of a rectangular paralellipiped, slightly truncated, open at the top to provide filling and emptying of said crates. It consists of 5 lattice panels 1, 2, 3, 4, 5 delimiting five faces of a parallelipiped, and the first face being the crate bottom (Reference 1), and the remaining four faces being the side walls (References 2 and 3), and longitudinal panels (References 3 and 5). The sixth open face (Reference 6) of the paralellipiped of which the contours are defined by an upper peripheral belt 6*a* delimits an opening permitting the filling of the vegetables on the upper face of the bottom panel 1, the internal faces of the wall panels 2, 3, 4, and 5, holding the vegetables to the crate height. As panels 1, 2, 3, 4, and 5 only play a retention role, they are much lighter and manufactured for this purpose in spaced vertical slats of the latticework type.

According to the principles of the present invention common to all crate types, the rigid frame providing resistance to deformation of the crate is formed by a lower peripheral belt 1*a* delimiting by the contours of the bottom panel 1, the upper peripheral belt 6*a*, and by four angled bracing columns 7, 8, 9, and 10.

To reinforce the resistance to deformation of the crate, the aforementioned upper perpiheral belt 6*a* will have the form of a rim protruding over the angled columns 7, 8, 9, and 10.

According to an especially advantageous characteristic of the present invention, illustrated further in details in FIGS. 3 and 3*a*, the crates according to the present invention are fitted with a wedge type device executed from 2 flat projections 11*a*, 11*b* which are attached to the outer side of one of the longitudinal rims of the upper peripheral belt 6*a*. These projections which extend parallel to the crate bottom 1 are positioned slightly below the end of said rim in such a manner as to allow its wedging below the rim of the contiguous crate. Preferably, these two projections 11*a* and 11*b*, will be asymmetrically positioned with respect to the center of said longitudinal rim to avoid an unwanted facing position when the two juxtaposed longitudinal rims are equipped with the wedging device of the present invention. In addition, the presence of these projections also serve as stop elements, inhibiting the straps which are used to restrain the crates from sliding along each other.

Crate 1, of the first case type, as illustrated by the drawings in FIGS. 1, 2, and 3, are characterized by their means of stacking and nesting constituted by projections and cavities preformed in the 4 angled columns 7, 8, 9, and 10. For this purpose, the angled columns 7 and 8 are preformed so that their wings extend toward side panel 2, with cavities 7*a* and 8*a* opening towards the crate interior, and columns 9 and 10 are preformed at the level of their wings extending towards side panel 2, located opposite side panel 2 with projections 9*a* and 10 oriented towards the crate interior, such that when two crates I situated one above the other are identically positioned (like those shown in FIG. 2), they stack one on top of the other. On the contrary, when the same 2 crates 1 are shifted 180°, projections 9*a* and 10*a* of both crates protrude into facing cavities 7*a* and 8*a* thus permitting the nesting of the upper crate into the lower crate.

Figure 1A:
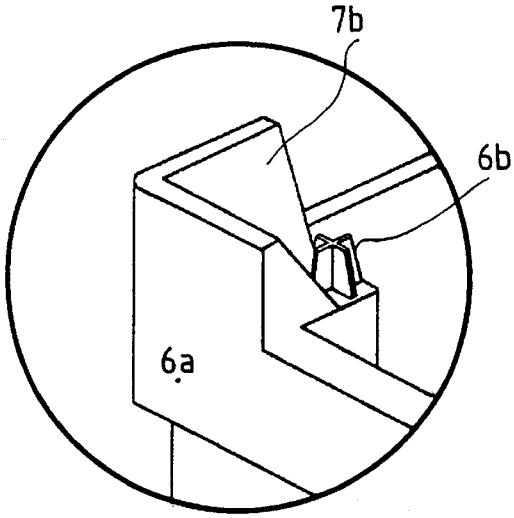
Figure 1B:
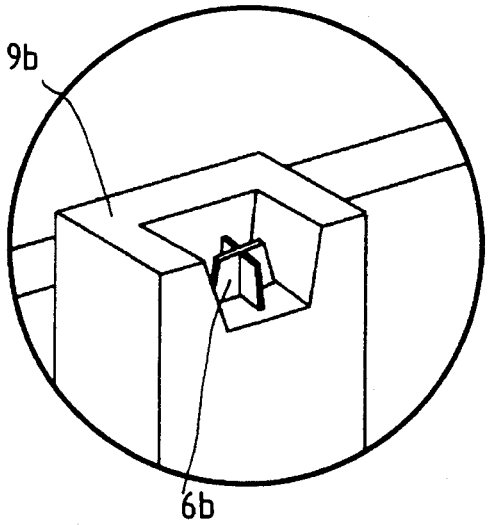

The upper peripheral belt 6*a* has projections 6*b* protruding outward near the angled columns 7, 8, 9, and 10 and designed to fit into corresponding through openings 1*b* (see FIG. 3) provided in the lower peripheral belt 1*a* (also near the columns), to receive projections 6*b* of the upper crate, regardless of the height of said projections. The shoulders 7*b*, 8*b*, 9*b*, and 10*b* are placed carefully on said upper peripheral belt 6*a* in the extension of the angled columns 7, 8, 9, and 10 and around the projections 6*b*. These shoulders, having the shape of two corner pieces 7*b*, 8*b* near cavities 7*a* and 8*a* and a "U-shape" 9*b* and 10*b* near projections 9*a* and 10*a*, are at a height greater than that of projections 6*b*. As can be seen from the drawings in FIGS. 1*a* and 1*b*, the internal walls of cornered shoulders 7*b*, 8*b* for one part and the U shaped shoulders 9*b*, 10*b* for the other part, have parts sloping towards said projections 6*b* so that they allow projecting to engage into said openings 1*b* of the upper crate, an engaging which is guided by the position of the lower parts of the angled columns 7, 8, 9, 10 of the crate fit in (per FIG. 2), first to the interior of the corner shaped shoulders 7*b* and 8*b*, and subsequently to the interior of the U shaped shoulders 9*b* and 10*b*. The upper faces of shoulders 7*b*, 8*b*, 9*b*, and 10*b* therefore define a bearing surface much larger than those of the tips of said projections 6*b* allowing the support of other cardboard crates not engaged on said projections, with no damage risk.

Crate II of the second case such as is illustrated by the drawings of FIGS. 4, 5, and 6 is characterized by these aforementioned means of stacking and nesting constituted by two hinged flaps 20 or 30 (mounted as indicated by the arrow "A" in FIG. 4*a*) on the lateral rims of the upper peripheral belt 6*a* such that they can either tilt down towards the interior parallel to bottom 1 of the crate to permit stacking of an upper crate of IIa (as shown in FIG. 5), or towards the exterior according to a 90° angular expansion in the end of the side walls in a direction opposite to that indicated by arrow A, to permit nesting of crate II in a lower crate IIb. The position of these flaps on the two side walls therefore permits stacking or nesting of the next crate, regardless of its presentation.

According to the present invention and as shown by the drawing of FIG. 4*a* illustrating the flap 20 and its hinging, the hinging line resulting to provide the hinge required for the hinging movement A is formed in the extension of the internal face of flap 20 on the one hand, and in the extension of the internal side wall face 2 on the other hand, in order to limit during the folding back of flap 20 towards the exterior (shown by continuous line in the drawing of FIG. 4*a*), a flap projection beyond said crate. In effect, in its extended position (see FIG. 4) flaps 20 and 30 remain in the continuation of the side wall (20 or 30) to which they were attached. In this manner, the perimeter of the upper belt of a nested crate is identical to that of a stacked crate, allowing association of stacked and nested crates, with no drawback. Flaps 20 and 30, raised vertically, engage into the inner part of the peripheral rim 6*a* of an upper crate II being placed on top of a crate IIb shown in the drawing of FIG. 5. Conversely, when flaps 20 and 30 are folded (Arrow A) in a horizontal position, as is the case for crate II illustrated by the drawing of FIG. 5, flaps 20 and 30 are held in this position by the angled columns 7, 8, 9, and 10 defining a bearing surface at the bottom 1 of crate IIa stacked above. Referring to the drawing of FIG. 4, it should be noted that the upper face of the upper peripheral belt 6*a* at the level of the side walls 2 and 4 upon which flaps 20 and 30 are hinged is at a lower level than the upper face, at the level of the two other longitudinal walls 3 and 5, according to a height difference equal to the thickness of flaps 20 and 30, such that said flaps folded towards the interior (ref. FIG. 4*a*) do not overlap the opening 6 of the crate. Advantageously, in order that flaps 20 and 30 can fold towards the interior bearing with all or part of their width on the ends of the longitudinal edges of the peripheral belt 6*a*, the upper face of the latter is sloped at its ends to be in the same plane as the upper face of the side walls 2 and 4. In this manner, each flap in a position folded towards the interior will rest on four bearing points, two at column level and two delimited by the recessed parts of the longitudinal walls 3 and 5.

According to the preferred embodiment of this invention, the outer face of flaps 20 and 30 is provided with longitudinal grooves 21 and 31 into which a longitudinal shoulder 1*a*' fits (ref. FIG. 4*b*) preformed at the level of the lower peripheral belt 1*a* on the crate bottom, which shoulder is provided in the extension of side walls 2 and 4. As can be seen in FIG. 5*a*, the grooves 21 and 31, provided in flaps 20 and 30 are larger than the shoulder 1*a*, having a shape flared towards the top to guide said shoulder. Being larger than the shoulder 1*a*', the groove 21 or 31 permits wedging said shoulder either against its internal side or against its external side, thereby offering a play allowing to compensate for the variations of shoulder heights as a function of different crate heights. In this manner, while keeping the same conic angle, it will be possible to stack crates having varying heights.

According to an especially advantageous characteristic of the present invention, the aforementioned longitudinal grooves 21 or 31 preformed in the flaps 20 and 30 are curved at their ends to form right angle bends, respectively 21*a* and 31*a*, such that when flaps 20 and 30 are folded towards the interior, the two grooves 21 and 31, viewed from above, appear as two "C's" one with another. These bends 21*a* and 31*a* are intended to receive part of the shoulder 1*a*' of the lower peripheral belt 1*a* preformed equally at the level of the longitudinal edges, thus securing crates stacked sideways or end to end.

As illustrated by the drawing of FIG. 6, the particular C shape of the grooves 21 and 31, of flaps 20 and 30, has an important role for the large crates IIc whose width is equal to the length of the small crates IIA and IIb and which the length is equal to twice that of the same small crates IIa and IIb.

In this manner, when the flaps 20 and 30 are folded towards the interior, as concerns the large crate IIc, two small crates IIa and IIb can then be stacked side by side in the large crate IIc. The shoulders 1*a*' of the lower peripheral belt 1*a* of the small crates IIa and IIb engage at the level of their longitudinal edges into the longitudinal grooves 21 and 31 of the large crate IIc, and at the level of the lateral edges, into the bends 21*a* and 31*a* of these same grooves. To perform this stacking of two small crates IIa and IIb on one large crate IIc, the latter is provided for in its longitudinal walls 3 and 5 of two central columns 40 and 50 arranged on their upper faces, of two "L" shaped grooves 41 and 42, (only shown on the drawing for column 40) such that the two legs of the L will both be parallel to the longitudinal grooves 21 or 31 and to their bends 21*a* or 31*a*.

It is understood that these packaging crates, which are herewith described and represented, have been designed and represented with a view toward disclosing, rather than limiting. Obviously many variations, modifications, and improvements may be made in the light of the abovementioned examples, without departing from this invention in its broader aspects and within its true spirit. To provide better understanding of the drawings, a list of references with their legends is hereby provided:

| | |
|---|---|
| I | Crates of the first embodiment. |
| II, IIa, IIb, IIc | Crates of the second embodiment. |
| 1 | Bottom panel. |
| 1a | Lower peripheral belt. |
| 1a' | Shoulder of the lower peripheral belt. |
| 1b | Openings. |
| 2.4 | Side wall panels. |
| 3.5 | Longitudinal wall panels. |
| 6 | Open face of the crate. |
| 6a | Upper peripheral belt |
| 6b | Projections. |
| 7, 8, 9, 10 | Angled columns. |
| 7a, 8a | Cavities. |
| 7b, 8b | Corner shoulders. |
| 9a, 10a | Projections. |
| 9b, 10b | U shaped shoulders. |
| 11a, 11b | Wedging projections. |
| 20, 30 | Hinged flaps. |
| 21, 31 | Grooves. |
| 21a, 31a | Bends in grooves 21 and 31. |
| 40, 50 | Central columns. |
| 41, 42 | Preformed bends in central column 40. |
| Arrow "A" | Tilting motion of flaps 20 and 30 towards the crate (inner part) and 30 towards the interior of the crate. |

We claim:

1. A crate for transport and storage of light vegetables, the crate comprising:

a bottom, two side walls, and two end walls, the walls having spaced slats in a latticework structure, a rigid framework comprising a lower peripheral belt, an upper peripheral belt, and a plurality of angled spacer columns joining the lower and upper peripheral belts, the walls having lower rigidity than the framework, the upper peripheral belt comprising a rim overlapping and protruding over the angled spacer columns, the spaced slats in the walls paralleling the angled columns; and stacking and nesting means, the stacking and nesting means comprising two hinged flaps extending from the tops of respective end walls on opposite sides of the crate, the flaps being rotatable about a hinge formed between each flap and the respective wall, each flap having an interior face and an exterior face;

each flap being rotatable from a first position permitting stacking of a second crate on the crate, the flaps being inclined towards the interior of the crate and parallel to the crate bottom in the first position, to a second position permitting nesting of second crate within the crate, the flaps being inclined towards the exterior of the crate in the second position, each hinge extending from the top of respective end walls on opposite sides of the crate such that the hinge is formed in the extension of the internal face of each flap on the one hand, and in the extension of the internal face of the respective end wall on the other hand, in order to limit the outward extension of the flaps when the flaps are in the second position.

2. A crate according to claim 1, the rim having an external wall, the crate further comprising at least one flat lug projecting from the external wall parallel to the crate bottom 1 and spaced from the top of the rim, such that the lug can be wedged below the rim of a contiguous crate.

3. A crate according to claim 1 wherein the upper peripheral belt comprises a rim protruding from the top of each of the end walls, and a rim protruding from the top of each of the side walls, each rim having an upper face, the upper faces of the end wall rims being lower by a predetermined height than the upper faces of the side wall rims, the predetermined height being at least equal to the thickness of the flaps.

4. A crate according to claim 1 further comprising a shoulder extending down at the periphery of the bottom from the walls, the external faces of the flaps each being provided with a longitudinal groove, the groove being formed to receive the shoulder of a stacked second crate when the flap is in the first position.

5. A crate according to claim 3, wherein the upper faces of the side wall rims have end portions formed in the same plane as the upper faces of end wall rims upon which are hinged the flaps, the ends of the flaps resting on the end portions of the upper faces of the side wall rims when the flaps are in the first position.

6. A crate according to claim 4 wherein the grooves provided in said flaps are wider than the shoulder at the bottom of the crate, the grooves being flared outwards towards the top.

7. A crate according to claim 5 wherein said longitudinal grooves are curved at their ends in such a manner as to form "L"-shaped curves to receive respectively curved portions of the shoulder.

8. A large crate and a small crate, each according to claim 7, the large and small crates being adapted to permit the stacking of two small crates on one large crate, the small crate having a length equal to the width of the large crate, and width equal to half the length of the large crate; and each of the side walls of the large crate further comprising a center column projecting towards the interior of the crate, each center column have an upper face, two "L"-shaped grooves being preformed in the upper face of each center column to receive respectively shaped portions of the shoulders of two small crates.

9. A crate for transport and storage of light vegetables, the crate comprising:

a bottom, two side walls, and two end walls, the walls having spaced slats in a latticework structure;

a rigid framework comprising a lower peripheral belt, an upper peripheral belt, and a plurality of angled spacer columns joining the lower and upper peripheral belts, the walls having lower rigidity than the framework;

upper peripheral belt comprising a rim overlapping and protruding over the angled spacer columns, the rim having an external wall;

at least one flat lug projecting from the external wall parallel to the crate bottom and spaced from the top of the rim, such that the lug can be wedged below the rim of a contiguous crate; and stacking and nesting means comprising two hinged flaps extending from the tops of respective end walls on opposite sides of the crate, the flaps being rotatable about a hinge formed between each flap and the respective wall, each flap having an interior face and an exterior face;

each flap being rotatable from a first position permitting stacking of a second crate on the crate, the flaps being inclined towards the interior of the crate and parallel to the crate bottom in the first position, to a second position permitting nesting of second crate within the crate, the flaps being inclined towards the exterior of the crate in the second position, each hinge extending from the top of respective end walls on opposite sides of the crate such that the hinge is formed in the extension of the internal face of each flap on the one hand, and in the extension of the internal face of the respective end wall on the other hand, in order to limit the outward extension of the flaps when the flaps are in the second position.

* * * * *